United States Patent [19]

Bredow et al.

[11] Patent Number: 4,624,044

[45] Date of Patent: Nov. 25, 1986

[54] ARRANGEMENT FOR STORING AND EXCHANGING OF TOOLS IN A POWER TOOL PARTICULARLY A REVOLVING CUTTING PRESS

[75] Inventors: Walter Bredow; Albert Schwarze, both of Alfeld, Fed. Rep. of Germany

[73] Assignee: C. Behrens AG, Alfeld, Fed. Rep. of Germany

[21] Appl. No.: 653,917

[22] Filed: Sep. 24, 1984

[30] Foreign Application Priority Data

Sep. 29, 1983 [DE] Fed. Rep. of Germany ..... 3335330

[51] Int. Cl.[4] ..... B23Q 3/155

[52] U.S. Cl. ..... 29/568; 72/446

[58] Field of Search ..... 29/568; 72/446, 448; 83/552

[56] References Cited

U.S. PATENT DOCUMENTS

| | | | |
|---|---|---|---|
| 3,727,442 | 4/1973 | Ridgway et al. | 29/568 X |
| 3,745,646 | 7/1973 | Kristiansson | 72/446 X |
| 3,816,904 | 6/1974 | Herb | 29/568 |
| 4,240,194 | 12/1980 | Inami et al. | 29/568 |
| 4,304,041 | 12/1981 | Kline et al. | 72/446 X |
| 4,404,729 | 9/1983 | Jensen et al. | 29/568 |

FOREIGN PATENT DOCUMENTS

| | | | |
|---|---|---|---|
| 44914 | 2/1982 | European Pat. Off. | 29/568 |

*Primary Examiner*—Gil Weidenfeld
*Assistant Examiner*—Steven C. Bishop
*Attorney, Agent, or Firm*—Michael J. Striker

[57] ABSTRACT

An arrangement for storing and exchanging tools in a power tool, especially a revolving cutting press, has a tool exchange device and a cassette magazine arranged on guides, wherein the tool sets insertable in or withdrawable from the press are held in receiving units arranged in magazine cassettes, and the tool exchange device and the cassette magazine containing several magazine casettes are so determined relative to one another that from the cassette magazine individual magazine cassettes can be transferred into the tool exchange device or from the tool exchange device into the cassette magazine.

32 Claims, 17 Drawing Figures

II
IV
III, X
19
3
4
8
9
9
9
9
10
2
20
21
89
18
17
14
88
1
15
16
13
IV 10
19
XI
2
5
3
6
4
7
8
9
1

49
68
9
49'
19
20
18
73
18
49'
9
68
49
73
18
68
9
49'
66
49
10
73
XII
21

XVI
XV
XIV
29
30
35
86
46
84
85
31
7
66
100
47
32
45
33
34
86,35

ARRANGEMENT FOR STORING AND EXCHANGING OF TOOLS IN A POWER TOOL PARTICULARLY A REVOLVING CUTTING PRESS

BACKGROUND OF THE INVENTION

The present invention relates to an arrangement for storing and exchanging of tools in a power tool, particular a revolving cutting press.

Known revolving cutting presses are provided in their revolving plates with a tool reservoir for individual tool sets including at least a punch, a stripper, and a matrix. By pure rotation of the revolving plate a tool set can be withdrawn from the respective working station and inserted into another station. Working of plate shaped workpieces with complicated geometrical shapes requires, however, a plurality of tools which exceeds the receiving capacity of such revolving plates so that there is a need to increase the tool reservoir available for a revolving cutting press.

It is known to manually assemble and disassemble the tool sets of the revolving plate, which, however, depending upon type and mounting of the tool, is connected with more or less complicated handwork and thereby brings time loss for the operation of the machine. For simplification of the tool exchange, tool receiving elements mounted on the revolving plates are developed which reduce handwork required for the tool exchange. Thereby a certain shortening of the time loss is obtained with an automated operation, or in other words, a tool exchange performed by manual gripping is not possible in this manner.

In the German patent application No. P 3,322,960.0 an arrangement for storing and exchanging of tools in a revolving cutting press is proposed, in which in addition to the revolving cutting press a magazine chain is arranged rotatable in a horizontal plane and carrying receiving segments for tool inserts. With the aid of a special tool exchange device provided with a gripping device the individual tool inserts can be withdrawn from the receiving segments of the magazine chain and inserted into the revolving plate. The revolving plate of the revolving cutting press must have for this purpose a design corresponding to the receiving segments, so that the receiving segments which completely contain the required tool in the upper or lower revolving plate, can be radially inserted into this revolving plate. For this known arrangement it is characteristic that in addition to the revolving cutting press, a magazine chain and a tool exchange device are arranged so that a certain minimum space consumption is obtained.

SUMMARY OF THE INVENTION

It is an object of the present invention to provide an arrangement for storing and exchanging of tools of the above-mentioned type, which is suitable for automated exchange of the tools, which tools provided for mechanical working of the plate-shaped workpieces for example in the revolving plates are considerably increased in their capacity, and which is characterized especially by a simple and space-economical design.

In keeping with these objects and with others which become apparent hereinafter, one feature of the present invention resides, briefly stated, in an arrangement which has at least one tool exchange device arranged for receiving at least one magazine cassette provided with several receiving units for the tool useable in the revolving plates of the revolving cutting press, wherein the receiving units are arranged in lines in the magazine cassette, the magazine cassette is motor driven in direction of the linear arrangement of the receiving units and arrestable in definite positions, and the receiving units for exchange of the tool are motor driven on the tool exchange device or the magazine cassette in direction to and from the revolving plate.

In the arrangement in accordance with the invention the tool exchange device is associated with the revolving cutting press and holds the tool provided in the revolving plates ready in individual receiving units, so that the dimension of the tool reservoir available for working by the revolving cutting press is increased in correspondence with the capacity of the magazine cassette The magazine cassette is arranged displaceable on the tool exchange device so that the tool held in the individual receiving units can be supplied to the revolving plates or the tool inserted in the revolving plates can be taken by these receiving units. It is important that only the tools are inserted into the revolving plate, whereas the receiving units as such are displaceable relative to the magazine cassette in direction to or from the revolving plate and not insertable into the revolving plate. The receiving units serve therefore only as engaging organs of the changeable tools, so that the converting works in the region of the revolving cutting press to make it suitable for cooperation with the inventive arrangement are limited to a minimum. The design of the magazine cassette can be any, but advantageously it is column like, the individual receiving units are held one above the other, and the magazine cassette is displaceable in its longitudinal direction on the tool exchange device. A circular ring-shaped design of the magazine cassette can be taken into consideration, wherein this magazine cassette is rotatably supported about an axis extending through the center point of the circular ring arrangement and normal to its plane. It is important that the magazine cassette is arrestable in definite positions which serve for the tool exchange process proper. The capacity of such a measuring cassette is practically limited only by its handling convenience, wherein the starting point is that the magazine cassettes can be inserted manually into the tool exchange device. It is however recommended that for insertion the magazine cassette hoisting device is provided to make possible exchange of greater units.

In accordance with another feature of the present invention the magazine cassette is supported vertically movably in the tool exchange device. This provides for the advantage of a space economical design of the inventive arrangement. Here for example a column-like design of the magazine cassette is provided and its vertical displaceability on the available standing surface is used in an optimal manner.

Still another feature of the present invention is that a tool storage device is associated with the tool exchange device, has a plurality of the magazine cassettes and is arranged for transferring or taking the magazine cassettes to or from the tool exchange device. With these features the capacity of the inventive arrangement is considerably increased, and it is important that the transfer of the magazine cassettes between the tool exchange device and the tool storage device can be performed without manual operation. It is thereby possible to insert each time fully automatically a tool located at the respective location of a respective magazine cassette or a tool set located here into the revolving plate in such a manner that the magazine cassette which contains this tool is transferred from the tool storage device to the tool exchange device and from here the tool is moved by respective movement of the magazine cassette to the revolving plates. For integration of such a revolving cutting press into a computer-controlled production a location coding of individual locations in the magazine cassettes is required so as to define the required control commands for example an NC or CNC control which is basic for a tool exchange.

Yet a further feature of the present invention is that the tool exchange device and the tool storage device designed as a cassette magazine are movable along horizontal and parallel stationary guides independently from one another in a motor-driven manner. This provides for the advantage that the tool exchange device with the tool storage device or the cassette magazine can be brought in a simple manner with one another in exchange action, for example they can be moved because of the parallel guides over one another. In this manner the structural features are simplified, which are required for manual engagement-free transfer of the cassette magazines from the tool storage device to the tool exchange device and vice versa. Since the tool exchange device is held movable independently of the tool storage device, it is possible for example during the running operation of the revolving cutting press in which the tool exchange device is integrated, to perform an exchange of complete cassette magazine with the tool storage device. Also in this manner, an important step for improved timely use of the revolving cutting press is taken.

Mounting of the guides of the tool exchange device and the tool storage device on the machine frame of the press means that the inventive arrangement practically does not require any own standing surface and makes possible a very compact structure. Advantageously, the tool storage device is formed as a cassette magazine in which the above-mentioned column-like magazine cassettes are arranged near one another, for example inserted in a vertically extending manner. The magazine cassettes lie here in the cassette magazine all in the same plane, so that with the vertical arrangement of the individual magazine cassettes a predetermined magazine cassette can be thereby transferred from the cassette magazine into the tool storage device in that the cassette magazine is moved horizontally so that this transfer is possible for example by vertical displacement of the magazine cassette to be transferred in the tool exchange device. The movement of the magazine cassette during the transfer from the tool storage device to the tool exchange device is substantially simplified in this manner.

In accordance with a further feature of the present invention, the tool storage device is formed as a drum rotatable in a horizontal plane, and having a peripheral region for receiving the magazine cassettes. This is a variation of the tool storage device which is also favorable. Here the column-like magazine cassettes are located along the peripheral region of a drum which is rotatable about its axis. The drum can be supported for example vertically relative to the tool exchange device so that the magazine cassettes also can be transferred to the tool exchange device or withdrawn from the latter by vertical displacement.

Still a further feature of the present invention is that the tool exchange device and the tool storage device, particularly the cassette magazine, are so movable relative to one another that a transfer of the magazine cassettes is possible in the vertical direction. These features provide for a structurally simple displaceability of the magazine cassettes.

Yet a further feature of the present invention is that both the tool exchange device and the tool storage device are provided with means for arresting the magazine cassettes in definite positions. This provides for the advantage that the magazine cassettes in both devices can be fixed in exactly defined positions, whereby the transfer or receipt of the magazine cassettes are simplified.

A next feature of the present invention is that a drive element arranged in the tool storage device is advantageously a braking motor associated with each magazine cassette and connectable via a switching coupling with a gear rack of the magazine cassette. This provides for the advantage that the insertion of the magazine cassette into the tool storage device is performed by the switched off and not engaged coupling so that the gear rack of the magazine cassette can be brought in engagement with the respective counter elements, for example, gear wheels, and because of the not engaged coupling these gear wheels are freely rotatable. Basically there is a possibility to provide such a switching coupling also in the event of the drive element associated with the tool exchange device. The drive elements are especially of importance when the tool exchange device is used without the inventive tool storage device.

An additional feature of the present invention is that each receiving unit is provided with two withdrawing pins arranged parallel at a distance from one another horizontally in the direction to the revolving press, wherein one withdrawing pin is rotatable about its longitudinal axis and is designed for form-locking arresting of the tool supported by both withdrawing pins. The function of the withdrawing pins is basically in the engagement of the tool to be exchanged and its fixing. The nonrotatably supported withdrawing pins perform here only a supporting function normally to the longitudinal axis, whereas with the rotatable supported withdrawing pins also an arresting function in the direction of its longitudinal axis is added to its supporting function. The adaptation works performed to the tools of the revolving cutting press are limited thereby on the inventive arrangement substantially providing respective openings in which these withdrawing pins for performing the tool exchange process are introduced, as well as to the struotural realization of a holder of the tool to make possible a respective displacement of the tool in direction of the displaceability of the receiving unit.

Another feature of the present invention is that the end region of the rotatable withdrawing pin has a circular-segment cross-section and a round part of the cross-section is provided with a locking groove, so that an arresting of the tool in direction of the longitudinal axis of the withdrawing pin is possible. This provides for a simple form-locking arresting with the aid of the rotatably supported withdrawing pin. For arresting, these withdrawing pins must be rotated so that the locking groove is brought in engagement with the respective counter element in the opening provided for the respective tool.

When the rotatable receiving pins are arranged vertically one above the other, the respective drive elements of the rotatable withdrawing pins are simplified. Starting from an individual rotary drive, all withdrawing pins can be driven for example with the aid of a gear rack.

The withdrawing pin or pins can be connectable with a rotary aggregate which is supported on a loading head displaceable on the withdrawing pins toward and from them. The loading head can be displaceable by a pneumatic double-acting cylinder-piston unit with a cylinder supported on an arm of the tool exchange device. The loading head can be brought in engagement in a form-locking manner with the receiving unit so that via the loading head the receiving unit can be displaced in longitudinal direction of the withdrawing pins. This provides the advantage in that with the aid of one functional element, namely the loading head, not only the rotatably supported withdrawing pin is coupled with a rotary aggregate, but also the receiving unit can be displaced in direction of the revolving plate of a cutting press or in direction from it. This function combination provides for a compact structure.

The magazine cassette can be provided with guiding pins extending parallel in the longitudinal direction of the withdrawing pins. With these features a supporting function is performed on the receiving unit during its process in direction to the revolving plate of the revolving cutting press. The receiving unit thereby brings in each working phase and exactly defined guidance.

In accordance with another feature of the present invention the receiving units have keys which extend substantially parallel to the direction of movement of the loading head and are in engagement with the respective grooves in the guiding rails. The keys can complete functions of the guiding pins and also replace the latter.

The loading head can be provided with an entraining claw, and an entraining piece formed on the receiving unit can engage in the entraining claw by movement of the magazine cassette in its longitudinal direction. This provides for the advantage in that no movable coupling element is required on the loading head to engage the receiving units. The latter is engaged by displacement of the magazine cassette whereby the receiving piece of the receiving unit is brought in form-locking engagement with the respective counter element, namely the receiving claw of the loading head. Also, in this manner, it is contributed to simplicity of the inventive arrangement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
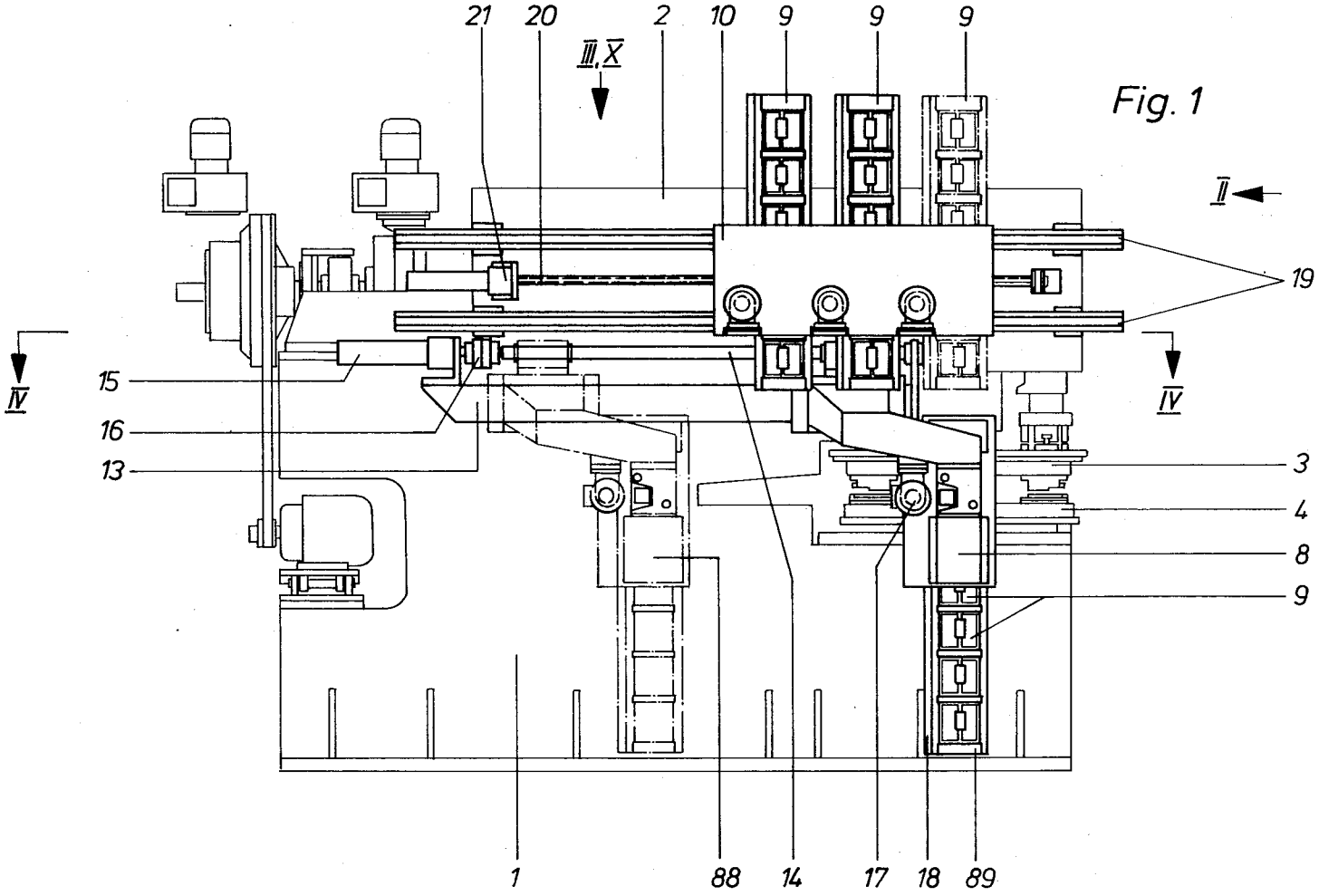
FIG. 1 is a side view of a revolving cutting press with an inventive arrangement.
Figure 2:
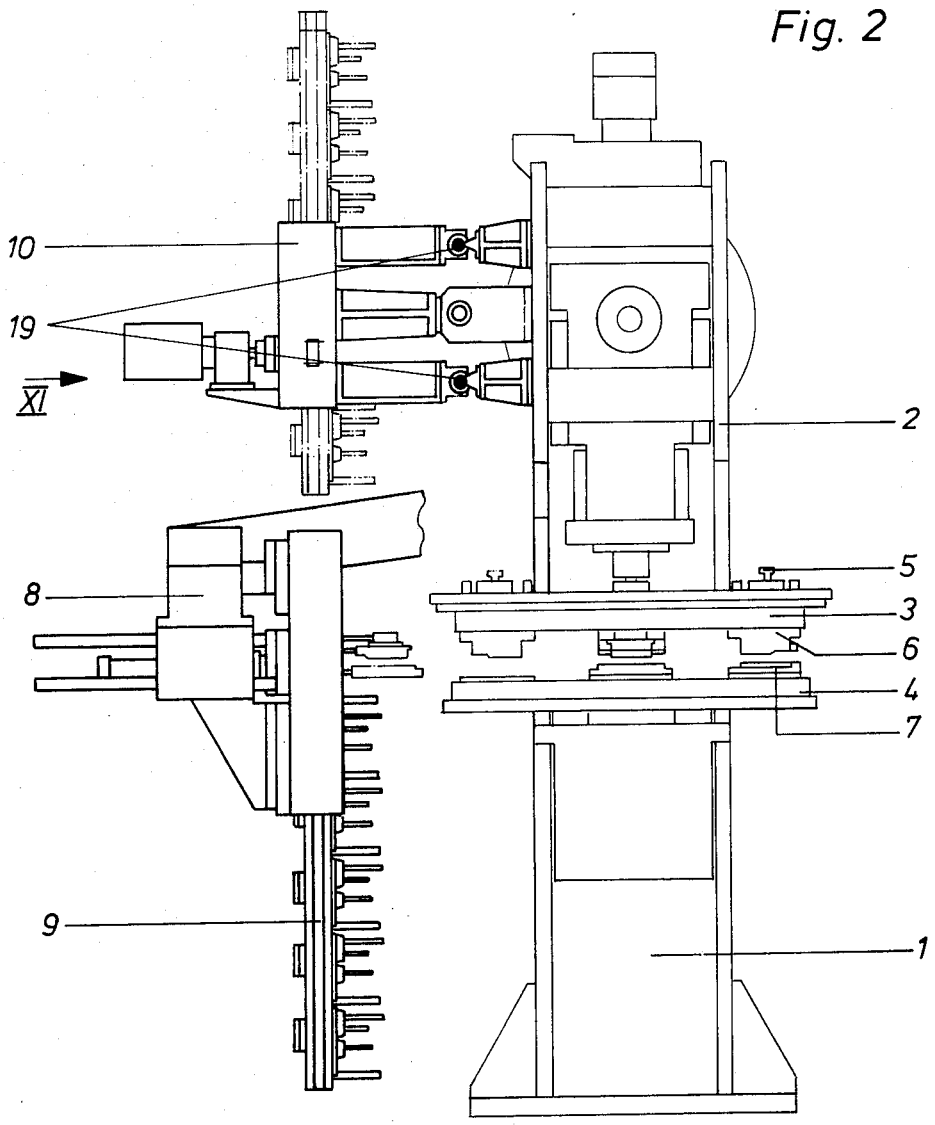
FIG. 2 is a front view as seen in direction of the arrow II in FIG. 1.
Figure 3:
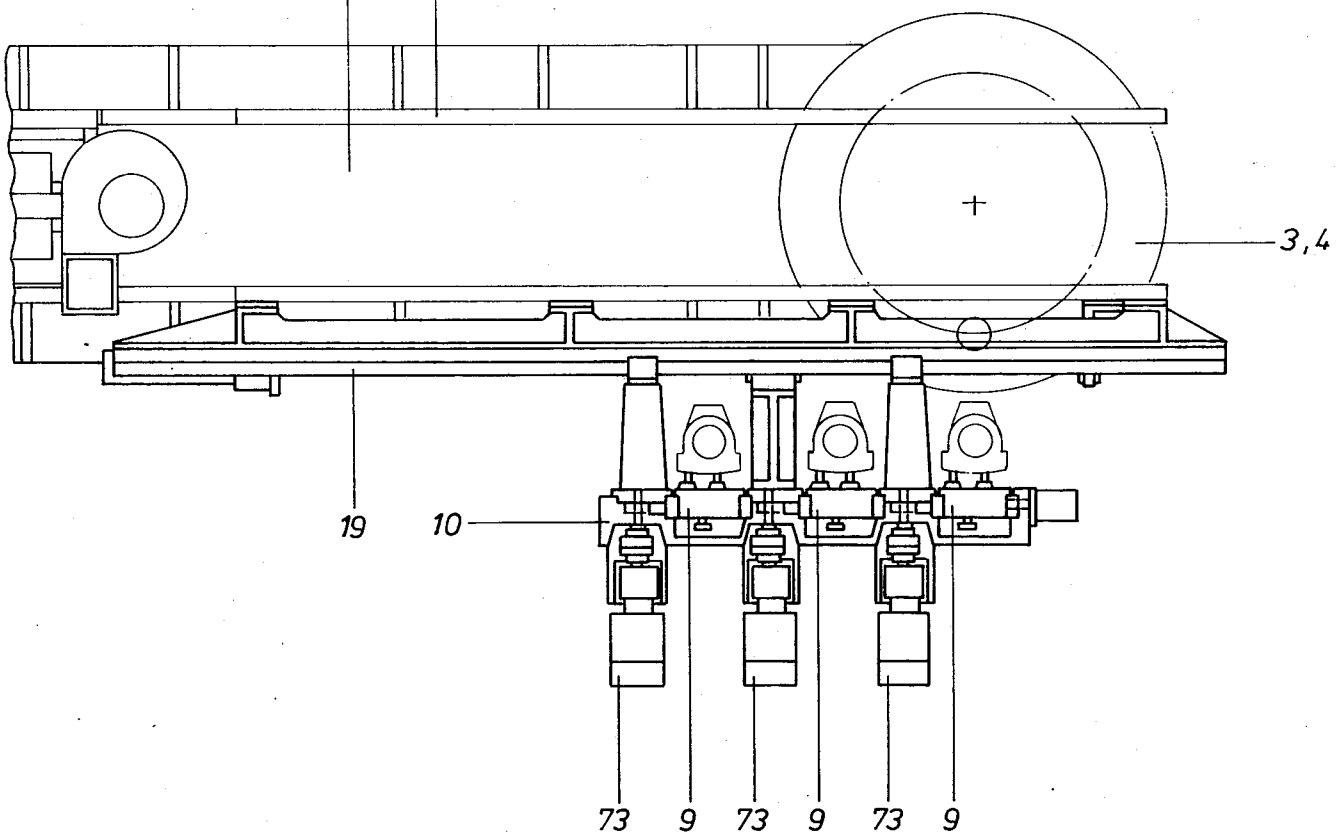
FIG. 3 is a plan view as seen in direction of arrow III in FIG. 1.
Figure 4:
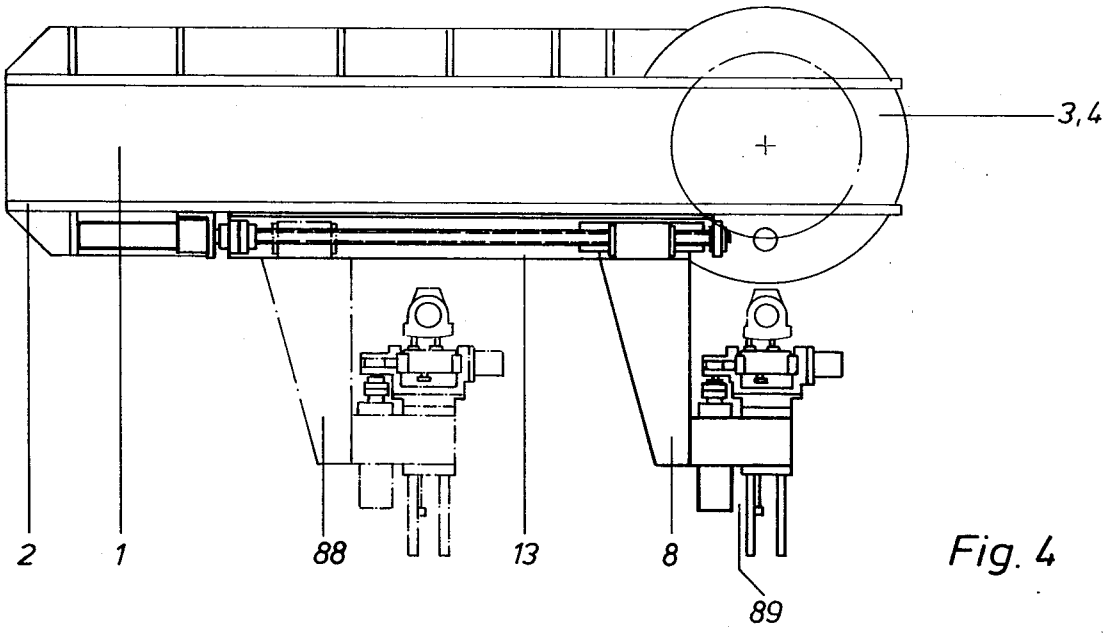
FIG. 4 is a view showing a section along a plane IV—IV in FIG. 1.

A revolving cutting press in accordance with the present invention is identified as a whole with reference numeral 1 in FIGS. 1–5. It has a machine frame 2 with two revolving plates 3 and 4 arranged at a distance one above the other and rotatable about a vertical axis. The revolving plates 3 and 4 carry along their periphery,-therefore in a circular arrangement, a row of tool sets each including at least a punch, a stripper, and a matrix.

The machine frame 2 carries laterally a horizontally extending guide 13 on which a tool exchange device 8 is displaceably supported. Displacement of the tool exchange device 8 is performed by a ball roll spindle 14 which is connected via a coupling 16 with a motor 15. The motor can be formed for example as a direct current motor. Also other systems can be used for driving of the tool exchange device along the guide 13, for example a pneumatic double-acting cylinder-piston unit.

The tool exchange device 8 whose structural features will be explained hereinbelow, is arranged to receive a magazine cassette 9 which serves as a support of a row of tool sets to be inserted into the revolving plates 3 and 4. The magazine cassette therefore has the function of a tool storage and will be explained hereinbelow.

In FIG. 1 the tool exchange device 8 is shown in its inoperative position 88 by a dash-dot line and in its working position 89 by a solid line.

The machine frame 2 carries further two horizontally extending guide rods 19 arranged above one another and located above the guide 13. The guide rods 19 serve for displaceable mounting at the magazine 10. The displacement of the cassette magazine 10 along the guide rods 19 is performed with the aid of a ball roll spindle 20 which is in operative connection with a motor 21.

The cassette magazine 10 whose construction will be explained in detail hereinbelow, serves for receiving a plurality of magazine cassettes 9, of which three are shown in FIG. 1, and therefore performs the function of a cassette storage. The individual magazine cassettes 9 can be selectively transported from the tool exchange device 8 into the cassette magazine or from the cassette magazine into the tool exchange device 8, individually and without manual gripping.

As can be clear from the above presented description, the tool storage capacity of the inventive revolving cutting press is thereby determined both by the receiving capacity of the inserted magazine cassettes 9, and also by their number accommodated in the cassette magazine 10.

Figure 5:
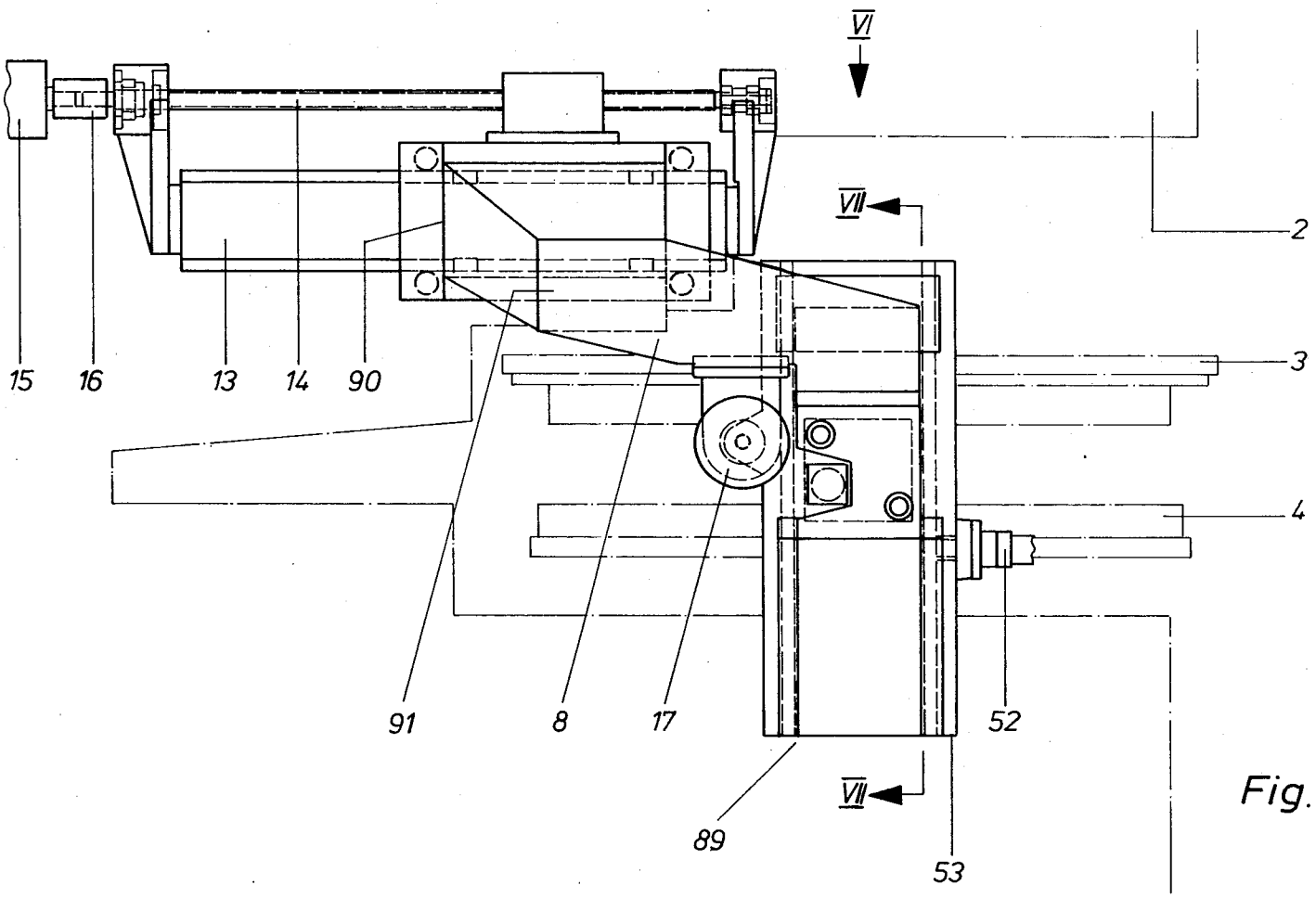
FIG. 5 is an enlarged view of a tool exchange device without an inserted magazine cassette.
Figure 6:
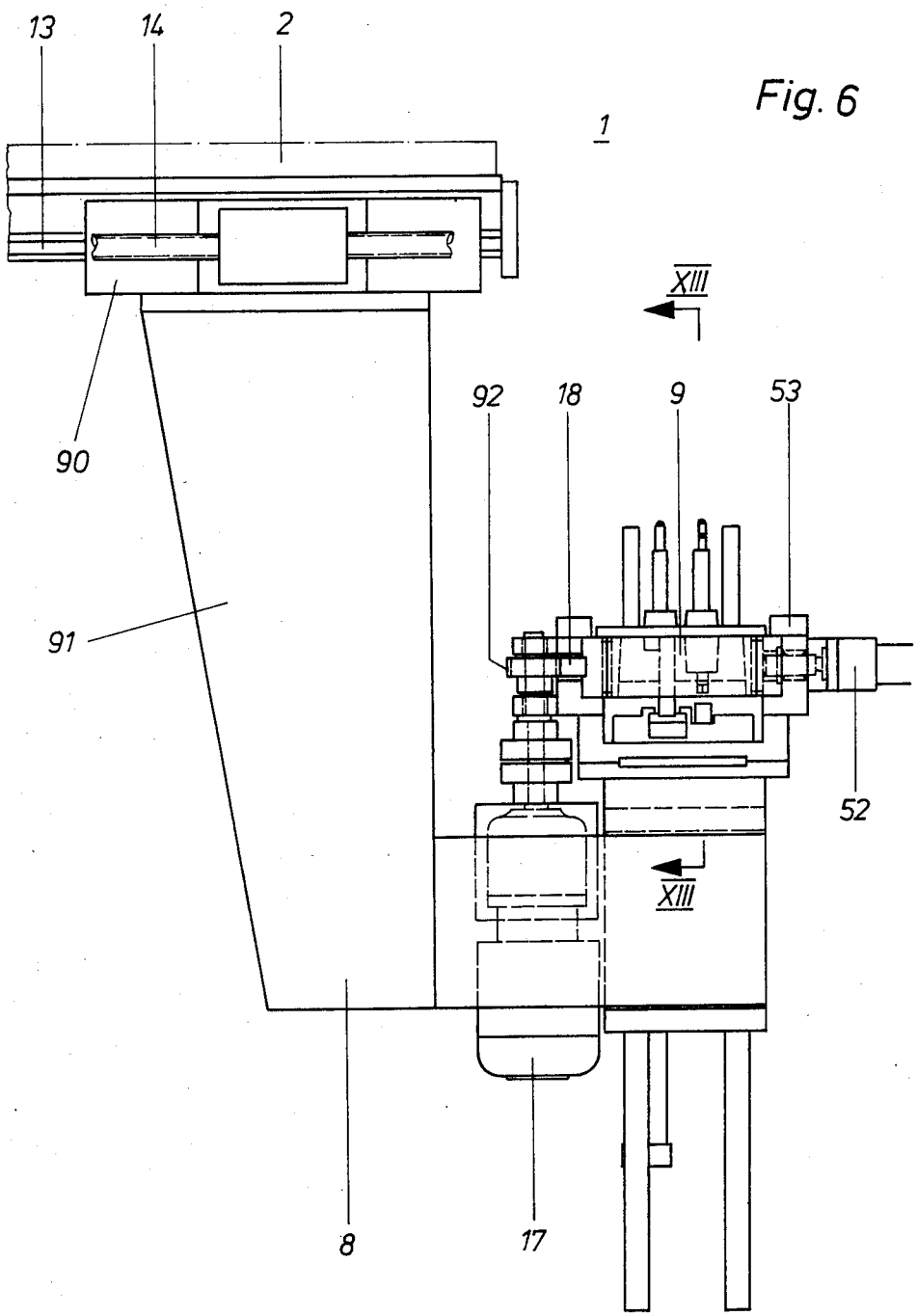
FIG. 6 is a plan view as seen in direction of the arrows VI in FIG. 5.

In the subsequent Figures the structural elements which correspond to the structural elements shown in FIGS. 1–4 are provided with the same reference numerals. FIGS. 5 and 6 show the tool exchange device 8 both in a side view and in a plan view. The tool exchange device 8 includes a carriage 90 which slides along the guide 13. An arm 91 is mounted on the carriage It extends from the revolving cutting press and is angled. A guiding frame 53 is mounted in the end region of the arm 91. The guiding arm 53 is U-shaped and open in the direction to the revolving cutting press 1. It serves for receiving and vertically guiding a magazine cassette 9 which in accordance with the construction shown in FIG. 6 is inserted vertically. The arm 91 carries moreover a motor 17 with a drive pinion 92 which is in engagement with a toothed rack 18 arranged to move vertically the magazine cassette 9. A cylinder-piston unit is identified with reference numeral 52 and arrests the magazine cassette 9 in predetermined positions which serve for the tool exchange process proper. Its exact arrangement will be discussed in detail later on.

Figure 7:
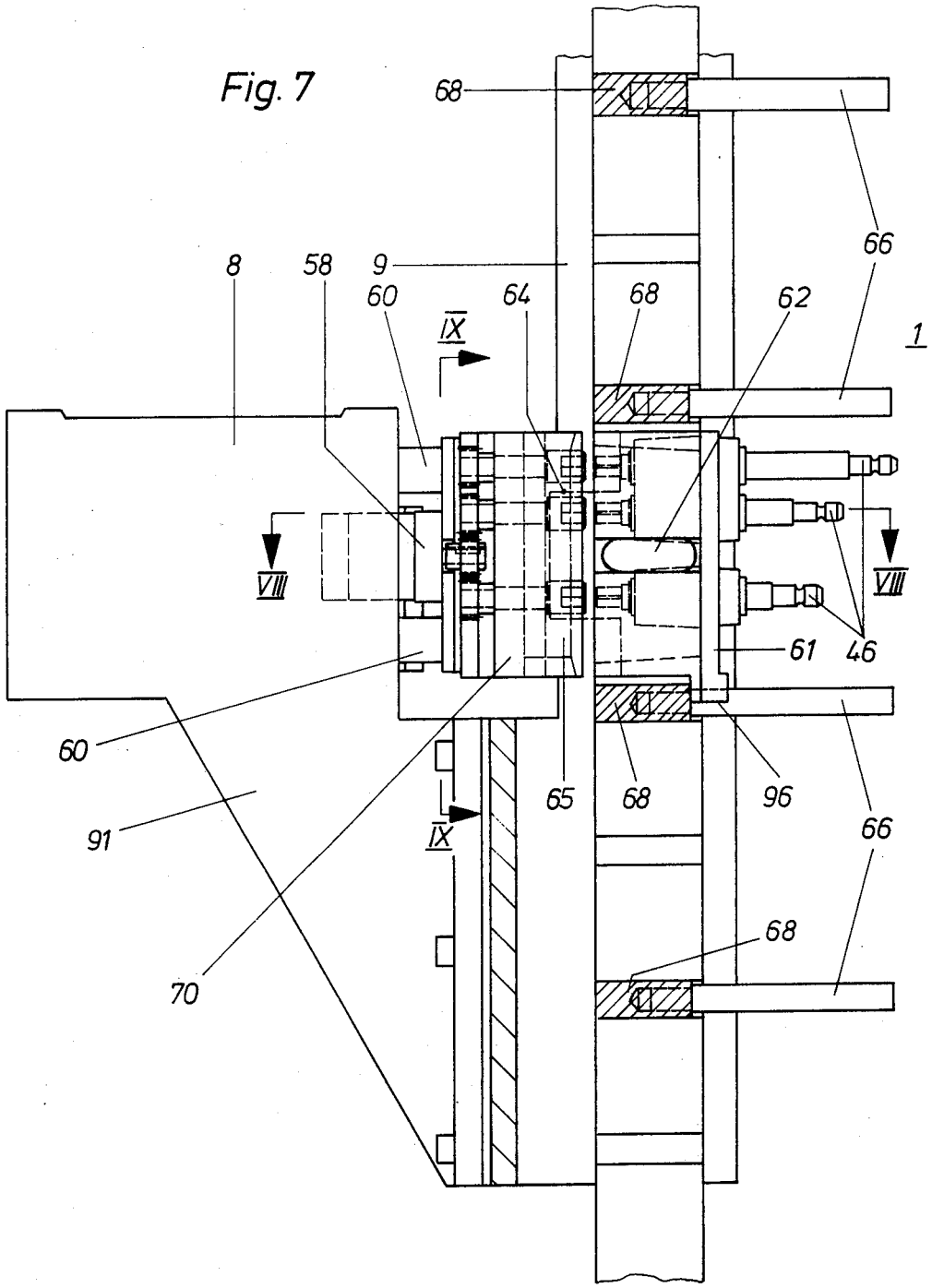
FIG. 7 is a view showing a section taken along the plane VII—VII of FIG. 5.
Figure 8:
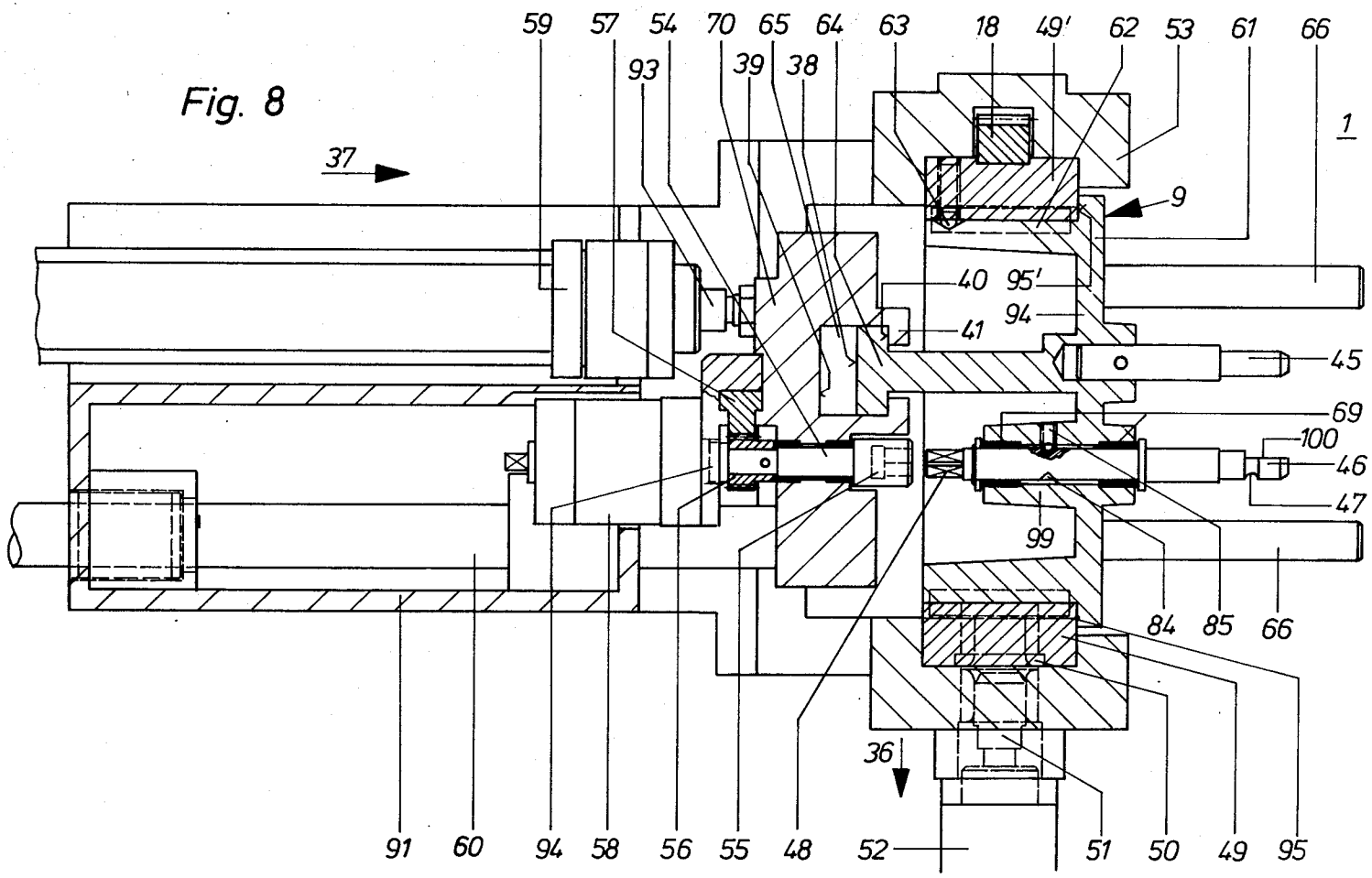
FIG. 8 is a view showing a section taken along the plane VIII—VIII in FIG. 7.

The inventive tool exchange device 8 in accordance with FIGS. 7 and 8 is provided with a loading head 70 which is supported displaceably along guide rods 60. The guide rods 60 are mounted on the arm 91 and extend in direction to the revolving cutting press 1. For motor-driven displacement of the loading head 70, a cylinder-piston unit 59 is provided with a cylinder supported on the arm 91 and a piston rod 93 connected with the loading head. The cylinder-piston unit 59 is loaded pneumatically at its both sides.

A rotary aggregate 58 is mounted on the loading head 70 and is formed, for example as an electric motor with an output shaft 94 cooperating with a gear rack 57 as will be described hereinbelow. The gear rack 57 is in turn in connection with three gear wheels 56 supported near one another in the loading head 70, as can be seen in FIG. 8. Each of these gear wheels 56 is supported on a shaft 54 which ends at its other end facing away from the gear wheel 56 in a coupling mouth 55.

The loading head 70 is provided with an entraining claw 65 which is in engagement with a respectively designed receiving piece 64 of a receiving unit 61 so as to provide a form-locking connection. The receiving unit 61 serves for mechanical handling of a tool set as will be described hereinbelow, and several such receiving units are inserted in the magazine cassette 9.

The receiving unit 61 has a basebody 9 which, as specifically shown in FIG. 8, is substantially U-shaped to the centrally arranged entraining piece 64, and supported at both sides between two vertically extending guide rails 49, 49' of the magazine cassette 9 in a vertical direction by keys 62. The keys 62 are laterally mounted on the receiving unit 61 in engagement with the respective grooves formed in the guiding rails 49, 49'.

The receiving unit 61 overlaps the guiding rails 49, 49' laterally at both sides, so that overlapping surfaces 95, 95' simultaneously form an abutment.

The guiding rails 49, 49' are bridged in predetermined equal distances by connecting webs 68 which are mounted in a not shown manner on the guiding rails. The vertical distance of two connecting webs substantially corresponds to the vertical dimensions of the receiving unit 61.

Guiding pins 66 are inserted, for example, screwed, into the connecting web 68. They extend horizontally in direction to the revolving cutting press 1 and serve for guiding the receiving unit 61. For this purpose, lower limiting edges 96 of the receiving unit 61, which face toward the revolving cutting press, are provided with two roughly semi-circular recesses 97 which lie on the guiding pins 66.

The vertical extension of the upwardly and downwardly open entraining claw 65 of the loading head 70, in which the entraining piece 64 of the receiving unit 61 is held in a form-locking manner, can be seen in FIG. 7. By vertical displacement of the magazine cassette 9 relative to the loading head 70, the entraining piece 64 can be withdrawn from the entraining claw 65. The receiving unit 61 is secured against an unintentional withdrawal in direction of the arrow 37 by a spring-loaded ball arresting pin 63 which is held in an opening of the guiding rail 49' and is bringeable in engagement with the respective recess of the receiving unit 61. Here, each receiving field of the magazine cassette 9 which is defined by two connecting webs 68 arranged one above the other, is associated with such a ball arresting pin 63 so that all receiving units located in the magazine cassette 9 are secured in this manner.

The guiding rail 49' of the magazine cassette 9 is fixedly connected at its outer side with the vertically extending gear rack 18 which in turn is in engagement with a not shown gear wheel located on the output shaft of the motor 17 (FIG. 1). For guaranteeing an exact position of the receiving unit 61 for tool exchange, an arresting bush 50 is located in the guiding rail 49. An arresting pin 51 can move in the arresting bush 50 and is in direct connection with the piston rod of the cylinder-piston unit 52. The cylinder of the cylinder-piston unit 52 which is pneumatically loaded at both sides, is mounted directly on the guiding frame 53. The arresting pin 51 movable in the arresting bush 50 thereby guarantees both an exact, definite vertical position of the magazine cassette 9, and its arresting in this position. The receiving unit 61 is provided at its side facing toward the revolving cutting press 1 with three pairs of withdrawing pins 45, 46 arranged one above the other, wherein the withdrawing pins45 are arranged rigidly while the withdrawal pins 46 are arranged rotatably. The withdrawing pin 46 has two bearing points 69 in a bearing block 99 of the receiving unit 61. An arrestin pin is arranged between the bearing points in an opening bearing block 99 and adapted to be brought into engagement with associated arresting notches 84, so that the withdrawing pin 46 is arrested in predetermined angular positions by this arresting notch.

The withdrawing pin 46 carries at its end facing toward the revolving cutting press 1 a portion 100 having a cross-section of a circular segment with a round part provided with a locking groove 47. At its other end facing away from the portion 100, the withdrawing pin 46 ends in a four-cornered pin 48.

Each of the three withdrawing pins 46 arranged one above the other is adapted to be brought via the four-cornered pin 48 by displacement of the loading head 70 into engagement with the coupling mouth 55 of the shaft 54. Thereby, with the aid of the gear rack 57 supported vertically displaceably relative to the loading head 70 and by the rotary aggregate 58 all three shafts 54 and thereby the associated withdrawing pins can be rotated. As will be explained hereinbelow, the vertical distance of the individual pairs of withdrawing pins 45, 46 and the distance of the withdrawing pins 45 from the withdrawing pins 46 depends on the revolving cutting press to be supplied with the tool sets.

The inventive tool exchange device is characterized in that on the slide 13 which is stationary relative to the revolving cutting press a carriage 90 is supported in a motor displaceable manner and carries the guiding frame 53 which in turn serves as a vertical guiding element for a magazine cassette, from which, with the aid of a loading head, individual receiving units provided with two sets in the above-described manner move horizontally in a direction toward the revolving cutting press.

Figure 9:
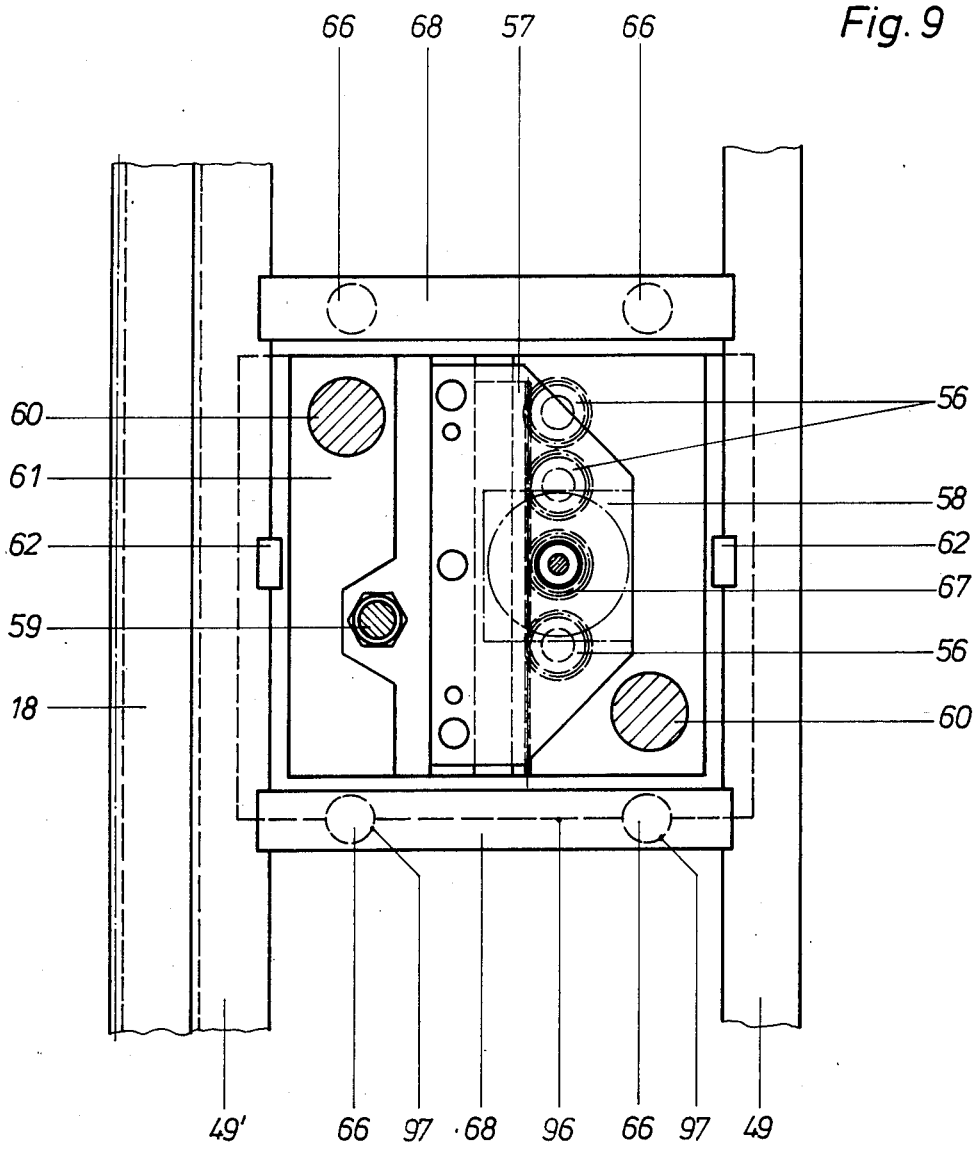
FIG. 9 is a view showing a section taken along the plane IX—IX in FIG. 7.

FIG. 9 shows particularly the gear wheels 56 arranged one above the other, and their driven connection with the gear rack 57, wherein the gear rack 57 in turn is driven via a transmission pinion 67 which is arranged directly on the output shaft of the rotary aggregate 58. Here there also can be recognized a substantially square shape of the receiving unit 61 and the loading head 70, as well as the position of the guiding rods 60 associated with the latter.

Figure 10:
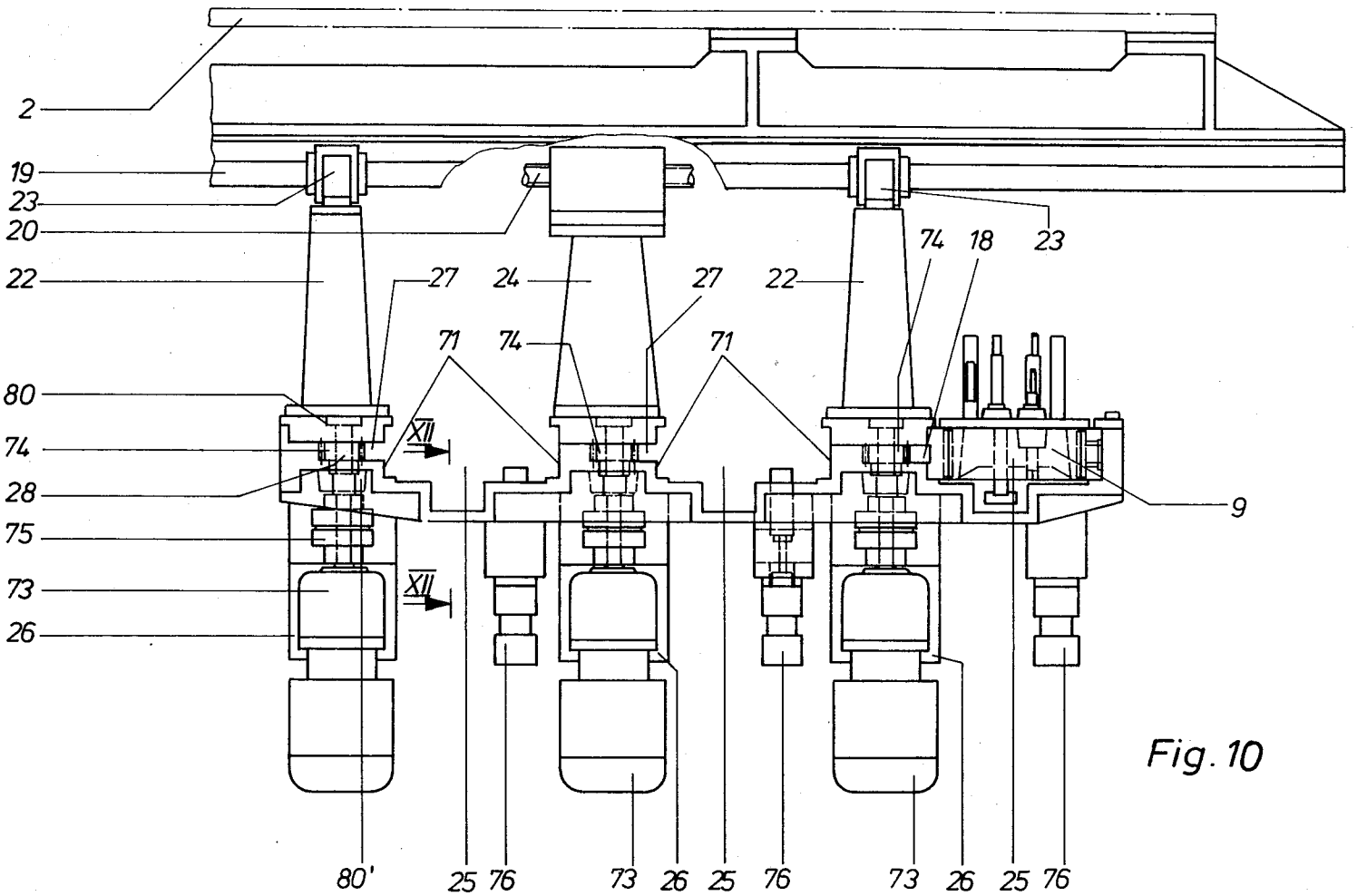
FIG. 10 is an enlarged plan view of the cassette magazine in direction of the arrow X in FIG. 1.
Figure 11:
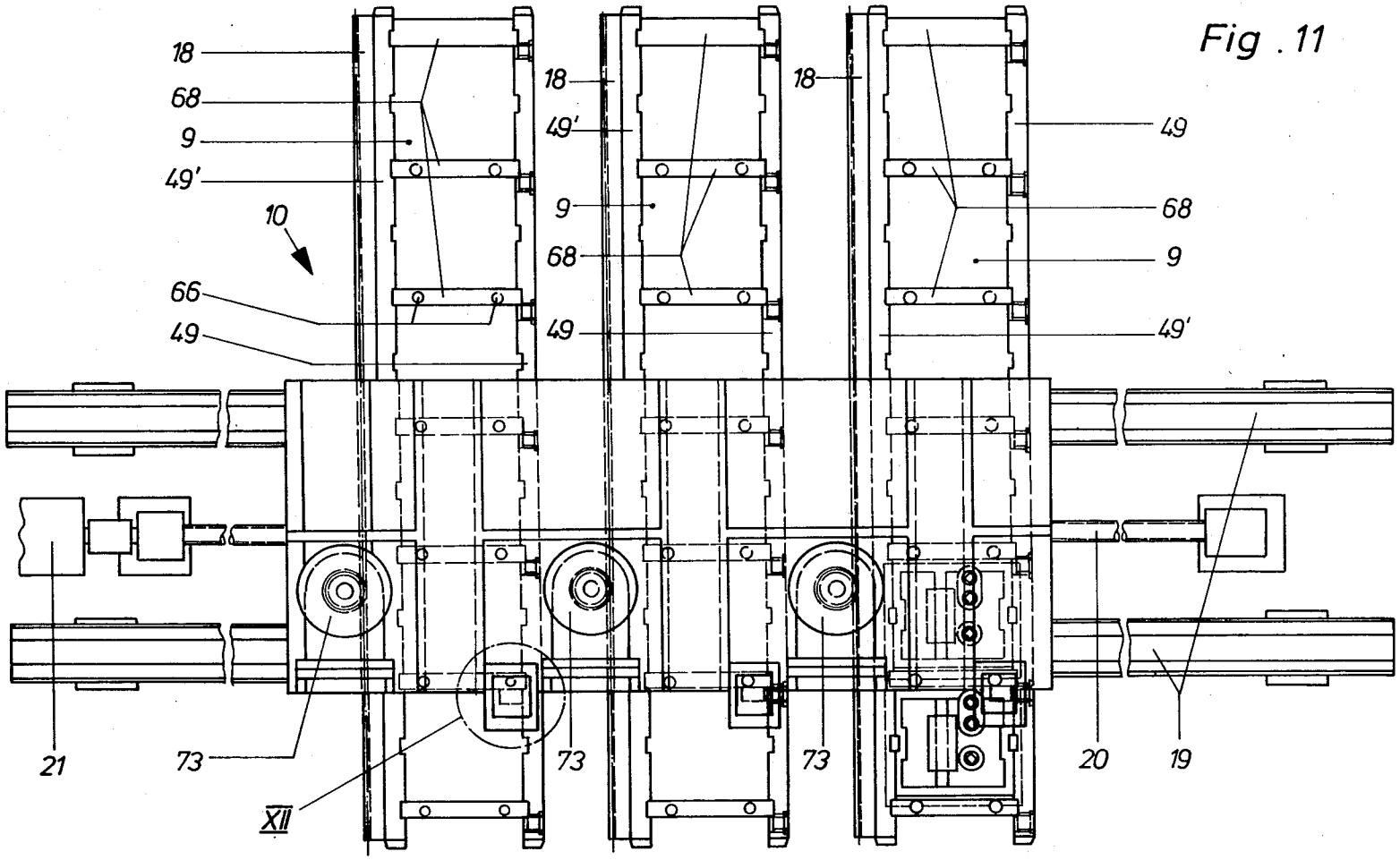
FIG. 11 is an enlarged view of the cassette magazine in direction of the arrow XI in FIG. 2.

FIGS. 10 and 11 clearly show the construction of the inventive cassette magazine 10. It includes two arms 22 arranged near one another which are formed in a pair and hold the guides 19 arranged over one another through sliding bushes 23. A central arm 24 serves for horizontal drive of the cassette magazine 10 along the guide 19 with the aid of the ball roller spindle 20 and the motor 21 shown in FIG. 1.

The arms 22, 24 at their end facing away from the guide 19 are connected with a guiding frame 71 by three substantially U-shaped guiding profiles 25. The vertically extending guiding profiles 25 are formed so that a magazine cassette 9 can be inserted into them from above and secured by the construction of the guiding profiles 25 in the horizontal plane. In FIG. 1 the magazine cassette is shown schematically when both remaining guiding profiles are empty. The guiding frame 71 is equipped with three horizontally extending mounting plates 26, and the guiding profile 25 is associated with each mounting plate. A braking motor 73 is mounted on the mounting plates 26 and has an output shaft which is connectable via a switchable coupling 75 with a gear wheel 74. The gear wheel 74 extends over a lateral recess 27 in the guiding profile 25 of the guiding frame 71. The gear wheel 74 is arranged on a shaft 28 which is supported by bearing points 80, 81.

The gear wheel 70 is in engagement with a gear rack 18 mounted on the guiding rail 49' of the magazine cassette 9. With the not switched coupling 75, or in other words with freely rotatable gear wheel 74, the magazine cassette 9 can thereby be inserted from above and therefore the gear rack 18 can be brought in engagement with the gear wheel 74.

The vertical extension of the cassette magazine 10, especially the guiding frame 71 is shown in FIG. 11 in detail.

Figure 12:
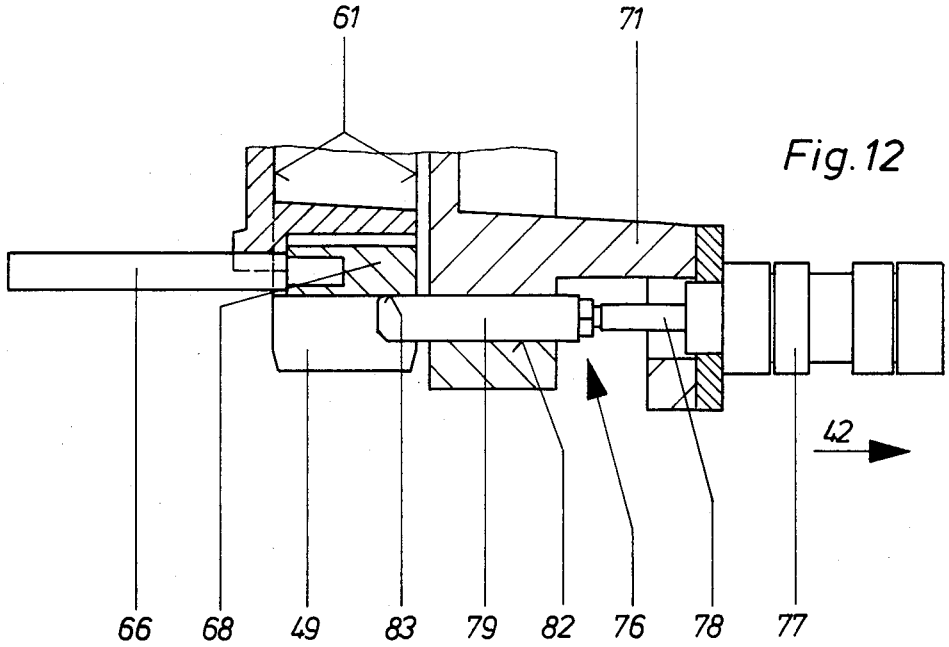
FIG. 12 is an enlarged view of a fragment XII in FIG. 11.
Figures 13, 14, 15, 16:
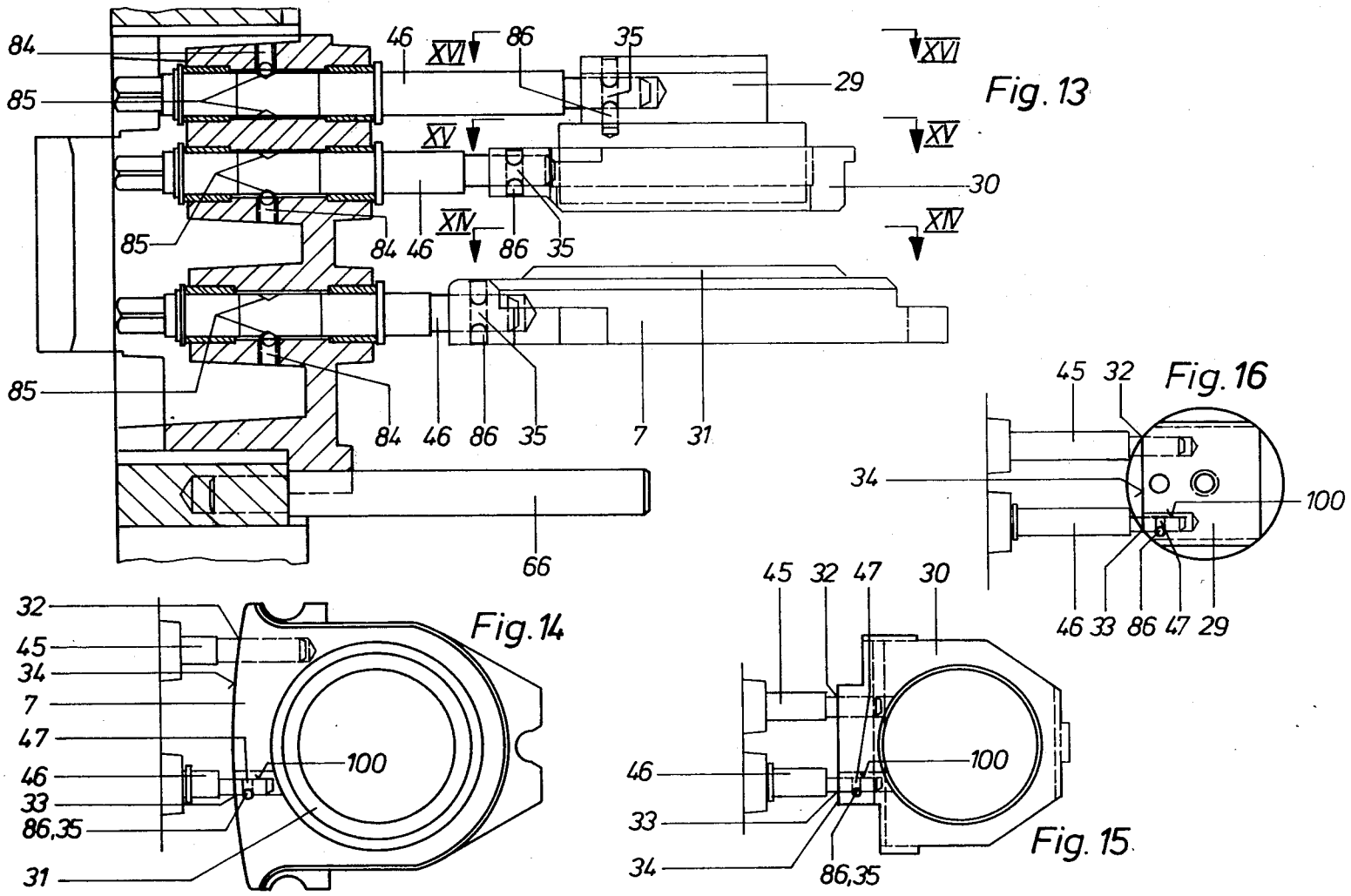
FIG. 13 is a view showing a section taken along the plane XIII—XIII in FIG. 6.
FIG. 14 is a view showing a section taken along the plane XIV—XIV in FIG. 13.
FIG. 15 is a view showing a section taken along the plane XV—XV in FIG. 13.
FIG. 16 is a view showing a section taken along the plane XVI—XVI in FIG. 13.

For vertical arresting of the magazine cassette 9, each guiding frame 71 or guiding profile 25 is provided with a special arresting device 76 arranged in the lower region of the guiding frame 71. The arresting device 76 is shown in FIG. 12. Here the arresting device 76 includes a cylinder-piston unit 77 with a cylinder mounted on the guiding frame 71 and a piston rod 78 directly connected with a slider 79. The slider 79 is guided in a cutout 82 of the guiding frame 71 so that it engages a connecting web 68 of the magazine cassette 9. The cylinder-piston unit 27 is pneumatically loaded at both sides, so that the slider 79 can displace under the connecting web 68. However it can be withdrawn into the cutout 82 for such a distance that a vertical movement of the magazine cassette 9 is not prevented.

FIGS. 13–16 show the equipment of the withdrawing pins 45 and 46 of the withdrawing unit 61 with a set of tools including a punch 29, a stripper 30, and a matrix shoe upper part 7 which carries a matrix 31. It is assumed that the punch and the matrix of the revolving cutting press are radially withdrawable from or insertable into the revolving plates 3 and 4 wherein the stripper is inserted in a stripper shoe and secured by known catches, and the matrix shoe upper part is radially insertable and fixable in a form-locking manner in a holder arranged on the upper side of the lower revolving plate. It is of importance that the punch 29, the stripper 30, and the matrix shoe upper part 7 are provided with openings 32, 33 extending parallel to one another, and openings 35 extend normal to the axis of the openings 33 at a predetermined distance from the outer limiting surfaces 34 of the punch 29, the stripper 30 and the matrix shoe upper part 7. The openings 35 penetrate in the edge region through the openings 33 and have substantially smaller diameters than the openings 33. The openings 35 serve for receiving of pins 86 which in this manner extend partially into the openings 33. The pins 86 and the openings 35 have a diameter corresponding to the locking grooves 47, so that by the cross-sectional profile of the locking groove 47 in connection with the opening 35 the pin 86 can be completely enclosed.

The function of the different withdrawing pins 45 and 46 is now understood and its operation is as follows:

While the non-rotatably supported withdrawing pin 45 assumes, after its insertion into the opening 32, substantially only a vertical supporting function, the rotatably supported withdrawing pin 46 assumes, in addition to the vertical supporting function, also a horizontal securing function, namely as long as the pin 86 is in connection with the locking groove 46 and unintentional withdrawal of the punch 29, the stripper 30 or the matrix shoe upper part 7 from the removing pins 45, 46 is prevented. With the insertion of the receiving pins 46 into the associated openings 33, the withdrawing pin 46 is located in a rotary position in which the portion 10 provided with a flattening is located at the side facing away from the pin 86 and thereby rotated relative to the showing of FIGS. 14, 15 and 16, by 180°. In this rotary position, the insertion of the withdrawing pins 46 into the openings 33 is not prevented by the pin 86. Subsequently, by rotation of the withdrawing pin 46 by 180° the locking groove 47 is brought in engagement with the pin 86 in a form-locking manner, so that the securing in the above-mentioned sense is obtained.

In this manner all receiving units 62 can be arranged in the magazine cassette, and the capacity of the cassette magazine 10 can be expanded in a simple manner, so that a greater tool reservoir is available which can be on call by programmed control and wherein the tool exchange of the revolving cutting press can be performed practically fully automatically in a computer-controlled manner.

Figure 17:
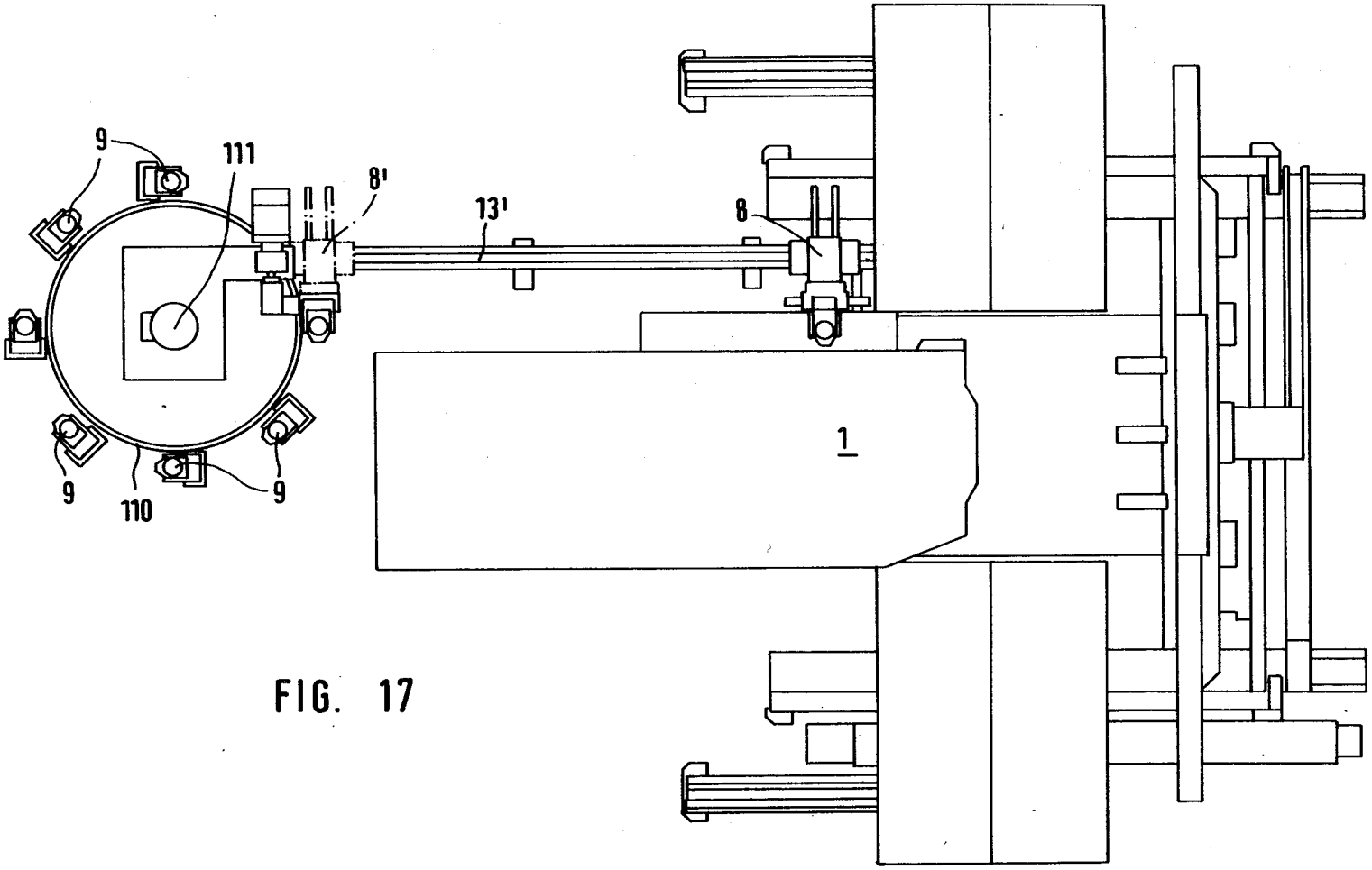
FIG. 17 is a top view of a revolving cutting press with a tool exchange device according to a second embodiment of the invention.

FIG. 17 shows a second embodiment of the tool exchange device with a different arrangement of the cassette magazine. In this embodiment, the cassette magazine is formed as a rotatable drum 110. The drum is driven by motor 111 to bring magazine cassettes 9 into position to be received by tool exchanger 8', which is movable on horizontal guide rails 13'. The tool exchanger then performs as in the first embodiment.

The operation of the inventive device for exchange and storage of the tool sets can be shortly explained as follows:

For exchanging a tool set including the punch 29, the stripper 30 and the matrix 31 and held in the revolving plates 3, 4 of the revolving cutting press 1, first the tool exchange device 8 is moved from its immovable position 88 by switching of the motor 15 along the guide 13 to its working position 89. It is assumed that a magazine cassette 9 is located in the guiding frame 53 of the tool exchange device 8, and its entire receiving field is provided with the receiving units 61. One receiving unit 61 contains the suitable tool set, whereas in contrast the withdrawing pins 45, 46 of a receiving unit magazine cassette 9 carry no tool sets. First by switching of the motor 17 to the respective rotary direction and pressure loading of the cylinder-piston unit 52 so that the arresting pin 51 is withdrawn in direction of the arrow 36 from the arresting bush 50, the magazine cassette 9 is moved vertically to bring the empty receiving unit 61 to a position to the revolving plates 3,4 which enables the tool exchange. In this position, first by stopping the motor 17 and the pressure loading of the cylinder-piston units 52, the arresting pin 51 is moved in the arresting bush 50 opposite to the direction of the arrow 36 so that the above-mentioned empty receiving unit 61 is fixed in this position.

Pressure loading of the cylinder-piston unit 59 follows, whereby the loading head 70 is moved along the guide rod 60 in direction of the arrow 37, or in other words, toward the revolving cutting press. Thereby the coupling mouth 55 brings into engagement each of the three shafts 54 (FIG. 9) with the respective three four-cornered pins 48 of the rotatably supported withdrawing pin 46. Simultaneously the pressing surface 38 of the entraining piston 64 abuts against the guiding surface 39 of the loading head 70, so that the receiving unit 61 is displaced along the keys 62 as well as the guiding pins 66 also in the direction of the arrow 37, or in other words toward the revolving cutting press. The displacement of the receiving unit 61 in this direction takes place for such a distance until the withdrawing pins 45, 46 are moved in the respective openings 32, 33 of the punch 29, the stripper 30 and the matrix shoe upper part 7 with the respective matrix 31 to be exchanged. During this insertion phase the withdrawing pin 47 is located in a rotary angular position in which the flattening of the portion 100 is located at the side facing toward the pins 86, so that an unobjectionable insertion is possible. In a next step, by actuation of the rotary aggregate 58 via the gear rack 57, the gear wheels 56, the shafts 54, the receiving pin 46 is rotated by 180° so that its locking grooves 47 are brought in engagement with the pin 86 in a form-locking manner. It should be mentioned at this point that an exchange of the punch, the matrix and the stripper presumes that, simultaneously with the insertion of the withdrawing pins 45, 46, eventually available locking elements with which the punch, the matrix and the stripper are secured in a horizontal plane, are released. Subsequently the cylinder-piston unit 59 is loaded in the opposite direction so that the loading head is moved along the guiding rod 60 in the opposite direction and thereby moves away from the revolving cutting press. The pressing surface 40 of the entraining piece 64 of the receiving unit 61 abuts against the guiding surfaces 41 of the loading head 70, so that as a result the receiving unit 61 is also moved in the direction opposite to the arrow 37. The displacement is performed for such a distance until the receving unit 61, as shown for example in FIG. 8 is inserted into the magazine cassette 9 and secured there by the ball arresting pin 63. Now, by actuation of the motor 17 with the cooperation of the gear rack 18 after withdrawal of the arresting pin 51, the magazine cassette 9 is moved vertically so that the receiving unit 61 which contains the tool set inserted in the revolving plate 3, 4 is located opposite to the loading head 70. In this position, the magazine cassette 9 is arrested in the above-described manner by the respective actuation of the cylinder-piston unit 52. By loading of the cylinder-piston unit 59, the receiving unit 61, subsequently in the above-described manner, is moved in a direction to the revolving plates 3, 4 and the tool set, in other words, the respective punch 29, the stripper 30, and the matrix shoe upper part 7 with the matrix 31 arranged thereon, are introduced into the revolving plate 3, 4. After rotation of the withdrawing pin 46 by the rotary aggregate 58, the locking connection between the locking groove 47 and the pins 86 is released and by respective actuation of the cylinder-piston unit 59, the now empty receiving unit 61 is withdrawn into the magazine cassette 9.

For the case that a respective tool set is available not in the magazine cassette 9 held in the tool exchange device 8, but in one of the magazine cassettes 9 available in the cassette magazine 10, this respective magazine cassette 9 must first of all be transferred from the cassette magazine 10 in the tool exchange device 8. For this purpose the cassette magazine 10 is moved by actuation of the motor 21 along the guide 19 to a position exactly above the exchange device 8. In this position the guiding profile 25 and the guiding frame 53 align with one another. After this aligned position is achieved, the coupling 75 which can be designed, for example, as an electromagnetic gear coupling is turned on, whereby because of the brake operating during stand still the braking motor 73, the magazine cassette 9 is arrested. Subsequently, by pressure actuation of the cylinder-piston unit 77 (FIG. 12) the slider 83 is withdrawn in the direction of the arrow 42 so far that an engagement of the connecting web 68 no longer takes place, the magazine cassette 9 is thereby held only by the braking motor 73. By switching-on of the braking motor 73, the magazine cassette 9 is lowered inside the guiding profile 25 and simultaneously the tool exchange device 8 is moved in the guiding frame 53. The tool exchange of the tool set located in the revolving plates of the revolving cutting press can then be subsequently performed in the above-described manner.

Equipping of the cassette magazine 10 with new tool cassettes 9 can be performed both manually, and also with the aid of a lifting jack, depending upon the mass to be transported. The locking of the individual tool holder sets by the withdrawing pins 45, 46 must be performed manually. For the exchange process one of the receiving units held in the magazine cassette 9 is left empty, so that it is available for receiving a tool set to be exchanged.

As can be understood from the above described, the inventive revolving cutting press can perform a tool exchange fully automatically in a computer-controlled manner, without manual gripping. The revolving cutting press is in this manner especially suitable for numerical control.

It will be understood that each of the elements described above, or two or more together, may also find a useful application in other types of constructions differing from the types described above.

While the invention has been illustrated and described as embodied in an arrangement for storing and exchanging tool sets in a machine tool, particularly a revolving cutting press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A revolving cutting press, comprising at least one revolving plate; a tool exchange device; a plurality of elongated rectilinear magazine cassettes and a cassette magazine, each of said magazine cassettes being provided with a plurality of receiving units arranged rectilinearly in a row and adapted for containing tool sets useable in said at least one revolving plate, said cassette magazine being formed for receiving said magazine cassettes arranged parallel to one another, said tool exchange device being arranged for receiving each of said magazine cassettes, said tool exchange device having a loading head cooperating with a respective one of said receiving units for fixing and displacement of a tool set in a direction towards and away from said revolving plate, said tool exchange device being provided with means for arresting and stepped displacement of said magazine cassettes in its longitudinal direction, said cassette magazine being formed so as to transfer any of said magazine cassettes to said tool exchange device.

2. A working cutting press as defined in claim 1, wherein said magazine cassettes are supported vertically movably in said tool exchange device.

3. A revolving cutting press as defined in claim 1, and further comprising horizontal stationary guides extending parallel to one another, said tool exchange device and said cassette magazine being motor driven independently of one another on said guides.

4. A revolving cutting press as defined in claim 3, wherein said magazine cassettes are motor driven vertically in said cassette magazine device a in direction of the arrangement of said receiving units.

5. A revolving cutting press as defined in claim 3, wherein the press has a machine frame, said guides being arranged to be mounted on the machine frame.

6. A revolving cutting press as defined in claim 1, wherein said cassette magazine is formed as a drum rotatable in a horizontal plane and having a peripheral region for receiving said magazine cassettes.

7. A revolving cutting press as defined in claim 1, wherein said tool exchange device and said cassette magazine are movable relative to one another so that a of said magazine cassettes is possible in a vertical plane.

8. A revolving cutting press as defined in claim 7; and further comprising gear racks with which said magazine cassettes are in fixed connection; said tool exchange device and said cassette magazine being provided with drive elements which cooperate with said gear racks.

9. A revolving cutting press as defined in claim 1, wherein said means for arresting and displacement of said magazine cassettes are formed as pneumatic double acting cylinder-piston units cooperating with elements which are movable in form-locking engagement with said magazine cassettes.

10. A revolving cutting press as defined in claim 9, wherein said elements include arresting pins.

11. A revolving cutting press as defined in claim 9, wherein said elements include sliders.

12. A revolving cutting press as defined in claim 8, wherein said cassette magazine has a driving element which is connectable via a switchable coupling with said gear rack of said magazine cassette.

13. A revolving cutting press as defined in claim 12, wherein said driving element is formed as a braking motor associated with each magazine cassette.

14. A revolving cutting press as defined in claim 1, wherein each of said magazine cassettes includes two guiding rails extending parallel to one another in thier longitudinal direction and at a distance from one another, and connecting webs extending normal to said guide rails at definite distances from one another and bridging said guiding rails.

15. An arrangement as defined in claim 14; and further comprising a displaceable loading head, said receiving units having keys which extend substantially parallel to one another in the direction of displacement of said loading head and being in engagement with grooves provided on said guiding rails.

16. A revolving cutting press as defined in claim 1; and further comprising means for arresting said receiving units in said magazine cassette.

17. An arrangement as defined in claim 16 wherein said arresting means are formed as spring-loaded ball arresting pins.

18. An arrangement as defined in claim 4; and further comprising a ball roller spindle connected with a drive and engaging with said tool exchange device.

19. An arrangement as defined in claim 1; and further comprising a ball roller spindle connected with a drive and engaging with said tool storage device.

20. An arrangement for storing and exchanging tools in a power tool for working plate shaped workpieces, particularly in a revolving cutting press having at least one revolving plate, the arrangement comprising at least one tool exchange device; at least one magazine cassette arranged in said tool exchange device; a plurality of receiving units provided said magazine cassette, for a tool useable in at least one revolving plate of the revolving cutting press, said receiving units being arranged in a linear arrangement in said magazine cassette, said magazine cassette being motor-driven in a direction of the linear arrangement of said receiving units and is supported arrestably in definite positions, said receiving units being motor driven for exchange of the tool in a direction toward and away from the revolving plate on said tool exchange device or said magazine cassette, each of said receiving units being provided with at least two withdrawing pins extending parallel to and at a distance from one another horizontally in a direction toward the press, one of said withdrawing pins being arranged rotatably about its longitudinal axis, and provided for form-locking arresting of the tool supported on both withdrawing pins.

21. An arrangement as defined in claim 20, wherein said one withdrawing pin has an end region with a cross-section of a circular segment, wherein a round part of said cross-section is provided with a locking groove so as to enable arresting of the tool in a direction of the longitudinal axis of said one withdrawing pin.

22. An arrangement as defined in claim 20, wherein one of said receiving units is associated with three pairs of said withdrawing pins arranged one over one another, each of said pair of said withdrawing pins including one withdrawing pin and another withdrawing pin.

23. An arrangement as defined in claim 22, wherein said withdrawing pins of said pairs are arranged vertically above each other.

24. An arrangement as defined in claim 20; and further comprising a rotary aggregate with which at least one of said withdrawing pins is connectable and which is support said loading head, motor driven in a direction to and from said withdrawing pins.

25. An arrangement as defined in claim 24; and further comprising a pneumatic double-acting cylinder-piston unit arranged to displace said loading head and having a cylinder, said tool exchange device having an arm supporting said cylinder.

26. An arrangement as defined in claim 24, wherein said loading head is adapted to be brought into form-locking engagement with said receiving unit, so that, via said loading head said receiving unit can be displaced in the longitudinal direction of said withdrawing pins.

27. An arrangement as defined in claim 24; and further comprising shafts each having an end region connectable with said one withdrawing pin, gear wheels mounted on said shafts, and a gear rack engaging with said gear wheels and supporting said rotary aggregate so that it is displaceable relative to said loading head.

28. An arrangement as defined in claim 20 wherein said one withdrawing pin is arrestable in fixed rotary angular positions.

29. An arrangement as defined in claim 21, each of said magazine cassettes is provided with guiding pins which extend parallel to the longitudinal direction of said withdrawing pins.

30. An a as defined in claim 29, wherein each of said magazine cassettes includes two guiding raiis extending parallel to one another in their longitudinal direction and at a distance from one another., and connecting webs extending normal to said guiding rails at definite distances from one another and bridging said guiding rails, wherein said guiding pins are mounted on said connecting webs and extend normal to a plane defined by said guiding rails.

31. An arrangement as defined in claim 30; and further comprising a gear rack extending parallel to one of said guiding rails and be-ng in fixed connection therewith.

32. An arrangement as defined in claim 26, wherein said loading head is provided with an entraining claw, said receiving unit being provided with an entraining piece engaging in said entraining claw during movement of said magazine cassettes in a longitudinal direction.

* * * * *